US005695251A

United States Patent [19]

Scolari

[11] Patent Number: 5,695,251

[45] Date of Patent: Dec. 9, 1997

[54] VARIABLE-INCLINATION HEADREST FOR A BED, ARMCHAIR, DIVAN AND THE LIKE

[75] Inventor: Massimo Scolari, Asolo, Italy

[73] Assignee: Giorgetti S.P.A., Meda, Italy

[21] Appl. No.: 611,809

[22] Filed: Mar. 6, 1996

[30] Foreign Application Priority Data

Mar. 15, 1995 [IT] Italy ..... MI95U0175 U

[51] Int. Cl.[6] ..... A47C 7/36

[52] U.S. Cl. ..... 297/408; 297/410; 297/362.11; 297/353; 5/634

[58] Field of Search ..... 297/408, 409, 297/410, 391, 353, 357, 358, 362, 362.11, 330; 5/635, 634, 621, 622

[56] References Cited

U.S. PATENT DOCUMENTS

| | | | |
|---|---|---|---|
| 206,379 | 7/1878 | Wilson | 297/362 |
| 1,095,397 | 5/1914 | Hillyer | 5/634 |
| 1,111,685 | 9/1914 | Allison | 297/353 |
| 2,239,732 | 4/1941 | Newhardt | 297/353 |
| 2,509,102 | 5/1950 | Kuebler | 297/353 |
| 2,603,275 | 7/1952 | Kuebler | 297/357 |
| 2,608,239 | 8/1952 | Gorden | 297/330 |
| 2,799,325 | 7/1957 | Wubbe | 297/362 |
| 4,958,392 | 9/1990 | Cannady . | |

FOREIGN PATENT DOCUMENTS

| | | |
|---|---|---|
| A-569 197 | 7/1958 | Belgium . |
| A-2 248 387 | 8/1992 | United Kingdom . |

*Primary Examiner*—Peter M. Cuomo
*Assistant Examiner*—Anthony D. Barfield
*Attorney, Agent, or Firm*—Herbert Dubno

[57] ABSTRACT

Variable-inclination headrest for a bed and the like is provided with a support element hinged on transverse elements integral with fixed uprights enabling the inclination of the headrest to be adjusted in accordance with individual needs while simultaneously displacing the backrest in a vertical plane with a rod transversely arranged between the uprights and designed to engage with one end of the support element so as to lock it in an erect position at a distance from the surface of a mattress or seat.

5 Claims, 3 Drawing Sheets

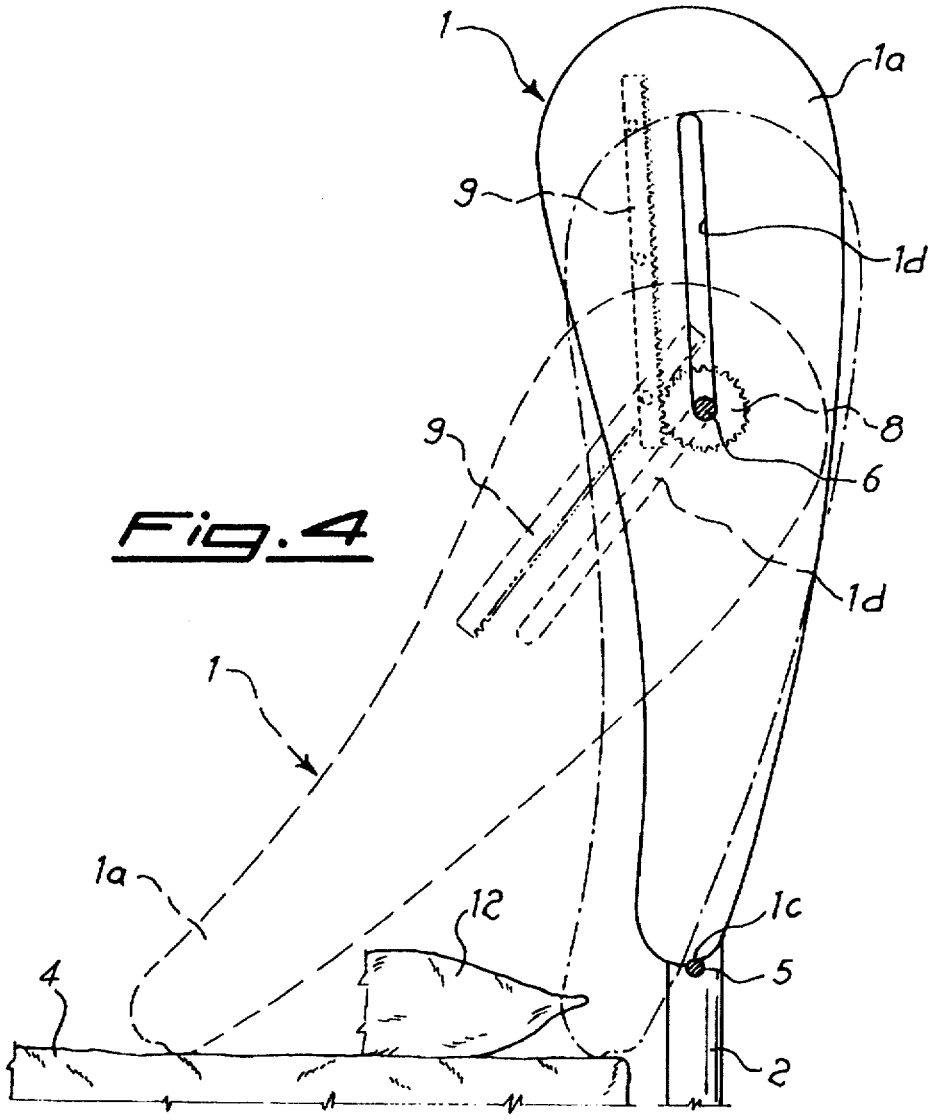
Fig. 4
Fig. 6a
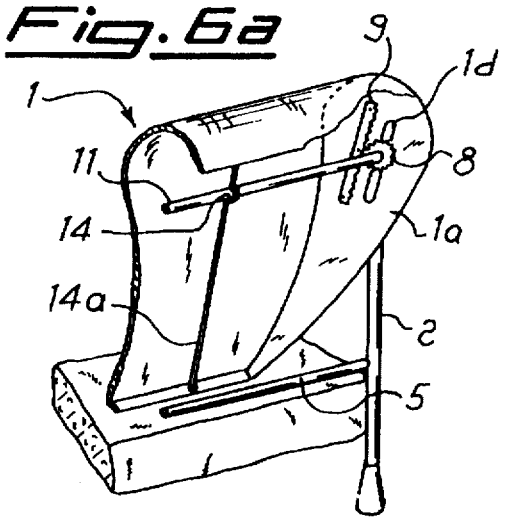
Fig. 6b
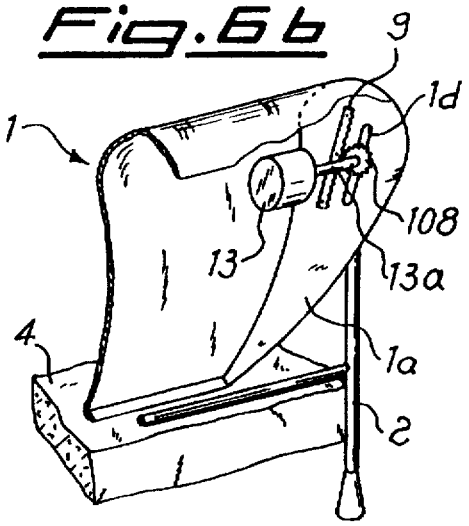

VARIABLE-INCLINATION HEADREST FOR A BED, ARMCHAIR, DIVAN AND THE LIKE

FIELD OF THE INVENTION

The present invention relates to a variable-inclination headrest for divan beds and the like.

BACKGROUND OF THE INVENTION

It is known how, in the production of divan beds and the like, there is the increasing need for the presence of devices which give the user the possibility of adjusting, as required, the angle of the headrest/backrest so as to be able to rest against it while maintaining the same degree of comfort for any angular position of the back with respect to the legs.

It is also known that, both in the case of double beds and multiple-seater divans, it is necessary to ensure the possibility of different and independent positioning of the headrest/backrest by the individual users so that one person is not obliged to adopt the same position as the other person.

Some embodiments of headrests and backrests have adjustable mechanism based on complicated numerous mechanical parts. Such structures in addition to increasing the cost of the assembly, make the headrest heavier, result in structural overdimensioning, and require preventive maintenance due to wear of the various component parts.

OBJECTS OF THE INVENTION

It is therefore a principle object to provide a rigid head or back support capable of adopting different angular positions.

Still another object is to provide a head or back support having a limited weight and easy maneuverability.

SUMMARY OF THE INVENTION

These objects are obtained by the present invention which provides a variable-inclination headrest for a bed, armchair, divan and the like, comprising a support element hinged, with the help of an associating operating means, on transverse elements integral with fixed uprights. A fixed means transversely arranged between the uprights and are designed to engage with one end of the support element so as to lock it in an erect position at a distance from the surface of a mattress or seat. The combination enables an angular displacement of the headrest to be adjusted in accordance with individual needs.

BRIEF DESCRIPTION OF THE DRAWINGS

The above and further objects, features and details will become more readily apparent from the following description, reference being made to the accompanying drawings, in which:

FIG. 4 shows a section along the plane indicated by IV—IV in FIG. 3 and showing the headrest in different angular positions;

FIGS. 6*a*, 6*b* are two alternative embodiment of the operating system according to the invention.

SPECIFIC DESCRIPTION

Figure 1:
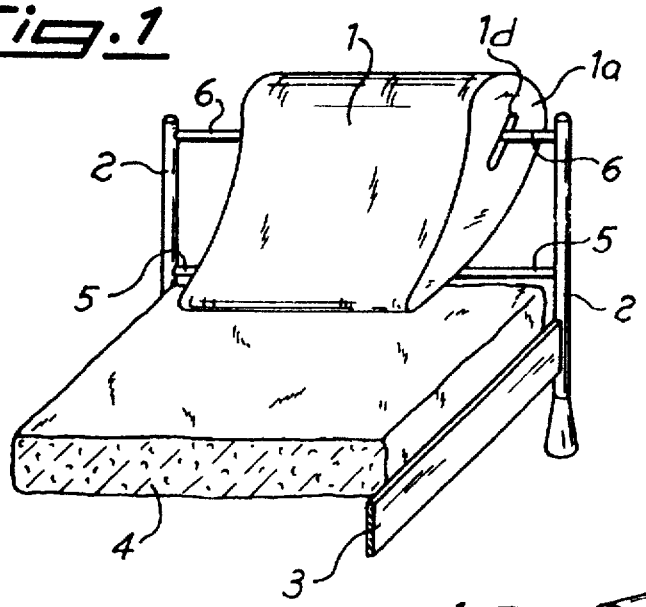
FIG. 1 is a perspective view of a bed with a headrest according to the invention.
Figure 2:
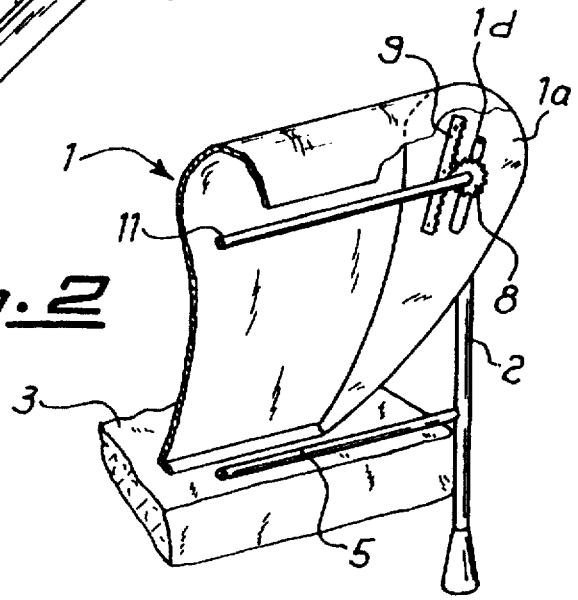
FIG. 2 is a partial and schematic rear view of a detail relating to the operating system of the headrest.
Figure 5:
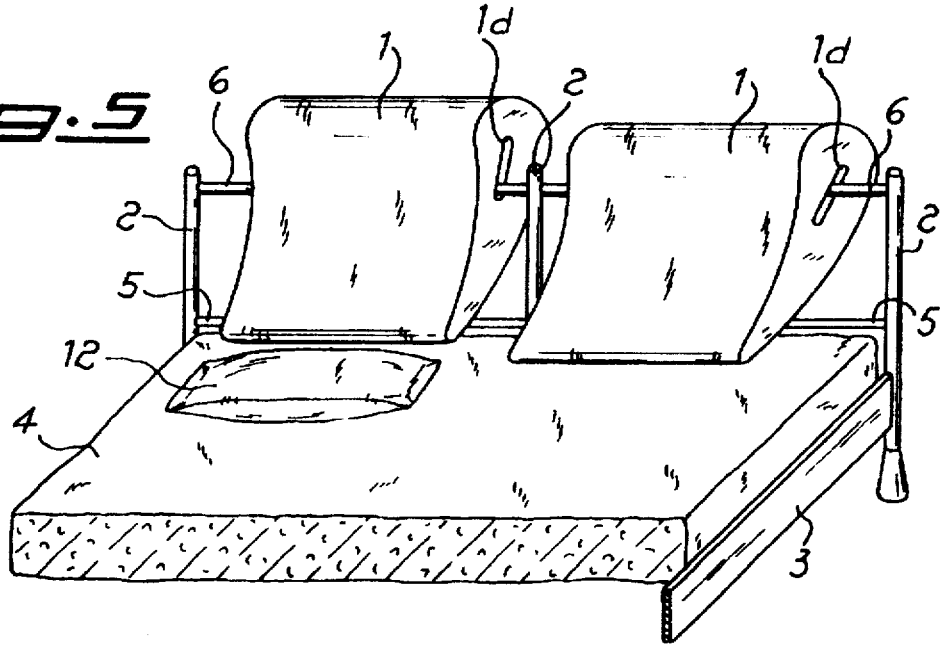
FIG. 5 is a perspective view of a double bed with the headrest according to the invention.

As shown in FIG. 1, the headrest for a bed according to the invention is composed of a support element 1 hinged on a pair of uprights 2 arranged on opposite sides of the frame 3 supporting the mattress 4. The uprights may be integral with the frame as shown in the FIG. 1, or may also be independent thereof.

The uprights 2 are joined together in the transverse direction by a lower bracing rod 5 and, at a suitable height from the ground, have a threaded hole 2*a* (FIG. 3) for coupling with a transverse pin 6 for hinging the support element 1, as will be described in detail below.

The support element 1 is substantially formed by two shaped and rigid side-pieces 1*a* joined together in the transverse direction for example by wooden slats 1*b* covered with straw matting or fabric so as to provide the necessary structural rigidity and supporting comfort.

The bottom horizontal edge of each side-piece 1*a* has a concavity 1*c* designed to cooperate with the lower transverse rod 5. Each side-piece 1*a* also has a longitudinal eyelet 1*d* designed to allow the pin 6 to pass through. The threaded end 6*a* of the pin is screwed onto the female thread of the hole 2*a* of the respective upright, while the butt 6*b* retains against the inner surface of the side-piece 1*a* and a bearing 7 which is keyed onto a toothed wheel 8 designed to cooperate with a rack 9 integral with each side-piece 1*a*. The toothed wheel 8 has a small front area 8*a* of contact with the surface of the side-piece 1*a* so as to generate a predetermined friction of force designed to control the downward movement of the support element 1.

The toothed wheel 8 has fixed to it, by means of screws 10*a* engaged in threaded holes 8*b* of the wheel a flange 10 supporting a rod 11 which joins together the toothed wheels of the opposite side-pieces 1*a* of the support element. The rod 11 ensures bracing of the structure so that it retains its parallel alignment during handling, thereby avoiding any jamming of the toothed wheels 8 on the respective racks 9 with consequent locking of the movement.

The mode of operation of the headrest is as follows: in the normal position (dot-dash line in FIG. 4) the support element 1 is positioned so that it is resting on the end of the mattress 4 in a substantially vertical position, thereby forming a conventional bedhead. In this configuration a cushion 12 is arranged on the mattress.

If, however, the person wishes to assume a partially erect position (broken line in FIG. 4), it is sufficient to pull forwards the bottom end 1*c* of the support element 1 which, in addition to rotating about the axis of the pin 6, will also tend to be displaced downwards by its own weight, actuating the toothed wheel 8 via the rack 9. The movement is permitted by the eyelet 1*d* through which the pin 6 passes.

The movement may be stopped in any intermediate position which is automatically maintained and stabilized by the weight of the person resting against it. In fact, a component of the weight force acts so as to push the support element 1 against the mattress 4, tending to stabilize the position and avoid undesirable slipping.

Obviously, by pushing the bottom end of the support element in the opposite direction, i.e. in the backwards and upwards direction, the element causes rotation of the toothed wheel 8 which, acting on the rack 9, raises the support element 1 itself. The support element during its return upward movement also rotates about the pin 6 and assumes a less inclined position, while still resting on the mattress.

Figure 3:
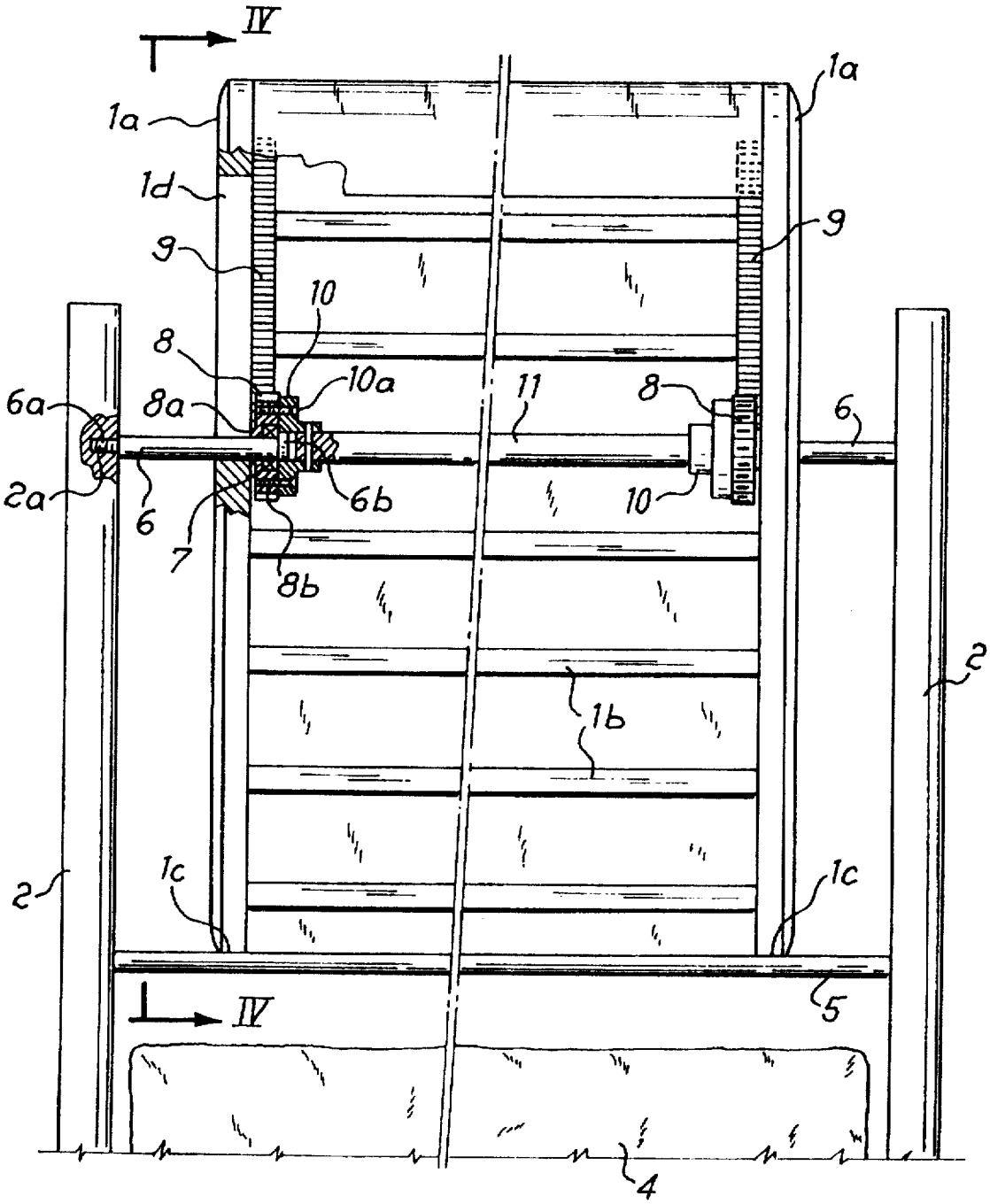
FIG. 3 is a partially sectioned rear view of the headrest according to FIG. 1.

As shown in FIGS. 3 and 4 in continuous lines, the support element 1 can also be brought into a vertical position, raised from the mattress 4. In this vertical position the bottom concave end 1*c* engages onto the transverse rod 5, thereby locking the support element 1. As can be seen in the FIGS. 3 and 4, the headrest is located at a distance from the mattress and leaves enough space such that the operations involved in tidying up of the bed can be easily performed.

As shown in FIG. 6*b*, the toothed wheel 8 may be operated by electric motor means 13, the shaft 13*a* of which has mounted on it the pinion 108 for operation of the support element 1. In such a case, the entire operating system would be mechanized and the user would be able to control the downward and return upward movement of the support by means of a switch or the like.

In addition, it is possible to provide a friction element consisting, for example, of a cord or wire 14*a* wound around the strut 11 in a corresponding seat 14 and connected to the top part and bottom part of the support element 1, said friction element ensuring regulation of the downward speed of the support element, which would thus be braked slightly.

Many variants may be introduced as regards the realization of the parts which make up the invention, without thereby departing from the protective scope of the present invention as defined in the claims which follow.

I claim:

1. An article of furniture comprising:

a frame provided with a body support and a pair of spaced apart fixed uprights flanking the support at a rear end thereof, each of the uprights being formed with a respective threaded hole formed close to a respective upper end of the upright;

a pin bridging the uprights and threadedly received in the holes;

an adjustable headrest member displaceably mounted on the pin between the uprights, the adjustable member including:

a pair of elongated rigid side pieces each formed with a respective longitudinal and thoroughgoing elongated slot traversed by the pin, so that the headrest member is pivotal about the pin between a vertical position of the headrest member and a plurality of angular positions, and a plurality of parallel and spaced apart transverse bracing elements bridging the rigid side pieces;

operating means for controllably guiding the headrest member substantially vertically and comprising:

a pair of toothed wheels each provided with a respective bearing and mounted spaced apart on the pin between the rigid side pieces, butt means for retaining the bearings against the respective side pieces, and a pair of parallel racks, each of the racks being mounted on a respective one of the side pieces and engaged with a respective toothed wheel to displace the headrest member between an upper position corresponding to a vertical position of the headrest member and a plurality of lower positions, the headrest member adjusting its angular position simultaneously with changing its lower position; and locking means fixed on the uprights below the pin for locking said headrest member in the upper position, the headrest member being spaced from the seat in the upper position and sliding upon said support in said lower positions.

2. The article of furniture defined in claim 1 wherein each of said toothed wheels is formed with a surface facing a respective side piece to generate a predetermined friction upon displacing said headrest member between said upper position and said plurality of lower positions.

3. The article of furniture defined in claim 1 wherein said headrest member further comprises a strut mounted on said pin between said side pieces and formed with a pair of spaced apart flanges fixed to the respective toothed wheels.

4. The article of furniture defined in claim 3 further comprising braking means mounted in said strut for slowing displacement of the headrest member between said upper position and said plurality of lower positions.

5. The article of furniture defined in claim 1 wherein said headrest member is formed with a bottom provided with an elongated concavity, said lock means including a rod engaging the concavity in the upper position of said support.

* * * * *